US006985854B1

(12) United States Patent
Mitsui

(10) Patent No.: US 6,985,854 B1
(45) Date of Patent: Jan. 10, 2006

(54) INFORMATION PROCESSING DEVICE, PICTURE PRODUCING METHOD, AND PROGRAM STORING MEDIUM

(75) Inventor: Suguru Mitsui, Tokyo (JP)

(73) Assignee: Sony Corporation, Tokyo (JP)

( * ) Notice: Subject to any disclaimer, the term of this patent is extended or adjusted under 35 U.S.C. 154(b) by 832 days.

(21) Appl. No.: 09/664,682

(22) Filed: Sep. 19, 2000

(30) Foreign Application Priority Data

Sep. 21, 1999 (JP) ..... 11-267754

(51) Int. Cl.
*G10L 21/00* (2006.01)

(52) U.S. Cl. ..... 704/220; 704/275; 704/276; 704/500; 381/119

(58) Field of Classification Search ..... 704/220, 704/275–276, 219, 500, 230; 381/119, 56; 84/622; 360/48; 407/115; 324/76.19; 282/275
See application file for complete search history.

(56) References Cited

U.S. PATENT DOCUMENTS 4,260,299 A * 4/1981 Ryan et al. ..... 407/115
4,973,897 A * 11/1990 Ohsawa ..... 324/76.19
5,153,829 A * 10/1992 Furuya et al. ..... 84/622
5,194,996 A * 3/1993 Shores ..... 360/48
5,633,981 A * 5/1997 Davis ..... 704/230
5,647,027 A * 7/1997 Burges et al. ..... 382/275
5,734,794 A * 3/1998 White ..... 704/275
5,974,387 A * 10/1999 Kageyama et al. ..... 704/500
5,978,487 A * 11/1999 Kusaba ..... 381/56
6,003,000 A * 12/1999 Ozzimo et al. ..... 704/219
6,490,359 B1 * 12/2002 Gibson ..... 381/119

OTHER PUBLICATIONS

Madisetti et al. , "The digital Signal Processing Handbook", 1998, ISBN: 0-8493-8572-5, pp. 51-35 and 51-36.*

* cited by examiner

*Primary Examiner*—David D. Knepper
*Assistant Examiner*—Qi Han
(74) *Attorney, Agent, or Firm*—Oblon, Spivak, McClelland, Maier & Neustadt, P.C.

(57) ABSTRACT

An information processing device in which a picture is displayed by being related to a sound. A selected picture (Psel) is switched on the basis of the change of the sound, and in the meantime, a composing method of a frequency-analyzed picture (Pspc) and the selected picture (Psel) is changed on the basis of the change of the sound.

8 Claims, 11 Drawing Sheets

OR

| | R | G | B |
|---|---|---|---|
| SELECTED PICTURE | 00001011 | 01001001 | 11001000 |
| SPE-ANA PICTURE | 00000000 | 11111111 | 00000000 |
| COMPOSED PICTURE | 00001011 | 11111111 | 11001000 |

FIG. 8A

XOR

| | R | G | B |
|---|---|---|---|
| SELECTED PICTURE | 00001011 | 01001001 | 11001000 |
| SPE-ANA PICTURE | 00000000 | 11111111 | 00000000 |
| COMPOSED PICTURE | 00001011 | 10110110 | 11001000 |

FIG. 8B

AND

| | R | G | B |
|---|---|---|---|
| SELECTED PICTURE | 00001011 | 01001001 | 11001000 |
| SPE-ANA PICTURE | 00000000 | 11111111 | 00000000 |
| COMPOSED PICTURE | 00000000 | 01001001 | 00000000 |

FIG. 8C

INVERTED AND

| | R | G | B |
|---|---|---|---|
| SELECTED PICTURE | 00001011 | 01001001 | 11001000 |
| INVERTED SELECTED PICTURE | 11110100 | 10110110 | 00110111 |
| SPE-ANA PICTURE | 00000000 | 11111111 | 00000000 |
| COMPOSED PICTURE | 00000000 | 10110110 | 00000000 |

FIG. 8D

Psel

OR

Pcomp

XOR

Pcomp

AND

Pcomp

INVERTED AND

Pcomp

INFORMATION PROCESSING DEVICE, PICTURE PRODUCING METHOD, AND PROGRAM STORING MEDIUM

BACKGROUND OF THE INVENTION

1. Field of the Invention

The present invention relates to an information processing device, a picture producing method, and a program recording medium, and more particularly, is suitably applied, for example, to an information processing device in which a spectrum analyzer picture and a background picture are composed and displayed.

2. Description of the Related Art

Previously, in an application program of a personal computer, there is a slide-show program in which a plurality of previously registered pictures are switched and displayed for each specified time interval. Furthermore, there are slide-show programs in which the sound output is simultaneously used, such as a program in which a music is outputted as BGM when displaying a picture or a program in which a sound effect is produced or the like at the time of switching a picture.

However, in such slide-show programs, the picture data and sound data are independently treated, and there has been a problem of not performing any bilateral display such as a display where the change of the sound data affects the display of the picture data.

SUMMARY OF THE INVENTION

In view of the foregoing, an object of this invention is to provide an information processing device, an picture producing method, and a program storing medium in which the picture is related to the sound to be displayed.

The foregoing object and other objects of the invention have been achieved by the provision of an information processing device which comprises sound signal obtaining means for obtaining a sound signal, sound signal analyzing means for frequency-analyzing the obtained sound signal, frequency-analyzed picture producing means that produces a specified frequency-analyzed picture on the basis of a result of the frequency analysis, selected picture switching means that switches and selects one among a plurality of registered pictures as a selected picture on the basis of a level of the obtained sound signal, and composed picture display means that displays a composed picture produced by composing a frequency-analyzed picture and a selected picture.

On the basis of a level of the sound signal, the selected picture is switched and it is composed with a frequency-analyzed picture, so that a composed picture changing according to the change of the sound signal can be produced.

Furthermore, in the present invention, a picture element of a frequency-analyzed picture and a corresponding picture element of a selected picture are logically operated to produce a composed picture, so that a composed picture changing without being late for the level change of the sound signal can be produced.

Furthermore, in the present invention, a composing method of a frequency-analyzed picture and the above described selected picture is changed on the basis of the level of the sound signal, so that a composed picture changing according to the change of the sound signal can be produced.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIG. 8 is an illustration showing a composing method of pictures;

DETAILED-DESCRIPTION OF THE EMBODIMENT

Preferred embodiments of this invention will be described with reference to the accompanying drawings:

(1) Configuration of Notebook-Sized Personal Computer

Figure 1:
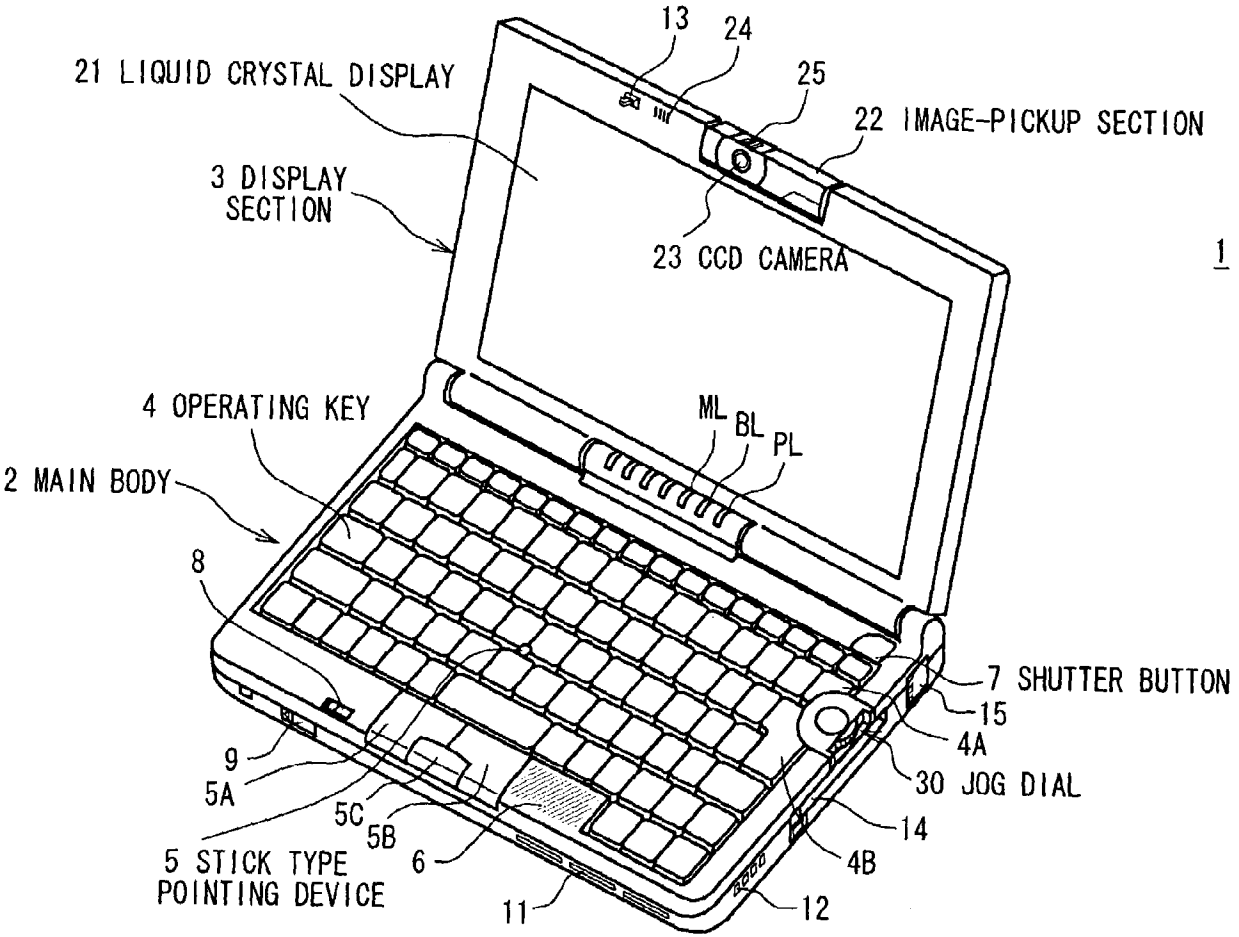
FIG. 1 is an illustration showing the total configuration of a notebook-sized personal computer according to the present invention.

In FIG. 1, reference numeral 1 denotes a notebook-sized personal computer (hereafter, this is called a note-PC) that configures an information processing device of the present invention as a whole, and it is configured by a main body 2 and a display section 3 attached to the above described main body 2 in a way in which opening and closing can freely be performed.

The main body 2 has, on the upper surface thereof, a plurality of operating keys 4 for inputting various characters, marks, and numerals or the like, a stick type pointing device 5 (hereafter, this is simply called a stick) that is used for the movement of a mouse cursor, a left click button 5A and a right click button 5B corresponding to a left button and a right button in a normal mouse, a center button 5C for operating a scroll button without fitting the mouse cursor to the scroll button, a built-in speaker 6, and a shutter button 7 for a Charge Coupled Device (CCD) camera 23 provided to the display section 3.

To the display section 3, at the front, a liquid crystal display 21 of a Liquid Crystal Display (LCD) is provided, and at the central upper end section in front, an image-pickup section 22 with a CCD camera 23 is rotatably attached to the display section 3.

That is, the image-pickup section 22 is arranged so that it may rotate within an angular range of 180 degrees between the front direction and the rear direction of the display section 3, and that it may be positioned at any position within the above described angular range. Furthermore, to the image-pickup section 22, an adjusting ring 25 for performing the focus adjustment of the CCD camera 23 is provided, and it is arranged that the focus adjustment at the time when a desired image-pickup object is image-picked up by the above described CCD camera 23 can easily be performed by the rotational operation of the adjusting ring 25.

Furthermore, to the display section 3, a microphone 24 is provided near the neighborhood on the left side of the image-pickup section 22, and it is arranged that the sound can also be gathered from the rear side of the display section 3 through the above described microphone 24.

Moreover, to the display section 3, a claw 13 is provided near the neighborhood on the left side of the microphone 24, and in the meantime, a hole 8 is provided at a specified position of the main body 2 corresponding to the above described claw 13, and it is arranged that the claw 13 is fitted in the hole 8 to be locked in the state where the display section 3 is closed onto the main body 2.

To the main body 2, a slide lever 9 is provided on the front side, and it is arranged that the lock of the claw 13 fitted in the hole 8 is released by sliding the above described slide lever 9, and that the display section 3 can be opened from the main body 2. Furthermore, on the front side of the main body 2, a plurality of ventilating holes 11 are provided.

Furthermore, on the right side of the main body 2, a ventilating hole 12, a PC card slot 14 corresponding to a Personal Computer (PC) card of Personal Computer Memory Card International Association (PCMCIA) standard, and a modem terminal 15 for a modular jack are provided.

Figure 2:
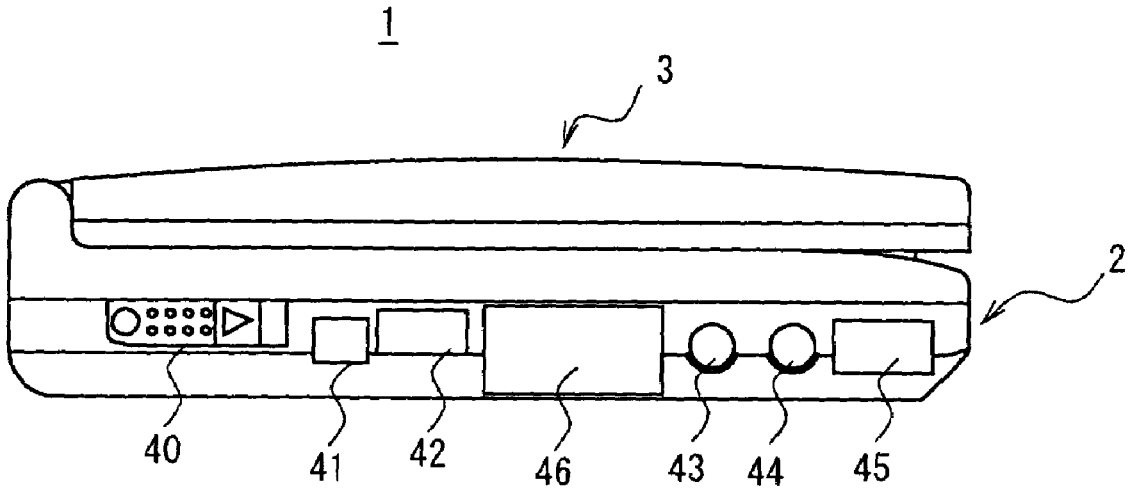
FIG. 2 is a side view showing the configuration of a left side of a main body.

On the other hand, as shown in FIG. 2, on the left side of the main body 2, a slide type power source switch 40, an Institute of Electrical and Electronics Engineers (IEEE) 1394 terminal 41 corresponding to four pins, a Universal Serial Bus (USB) terminal 42, an external display connector 46, a microphone input terminal 43, a headphone terminal 44, and an infrared port 45 based on Infrared Data Association (IrDA) are provided.

Figure 3:
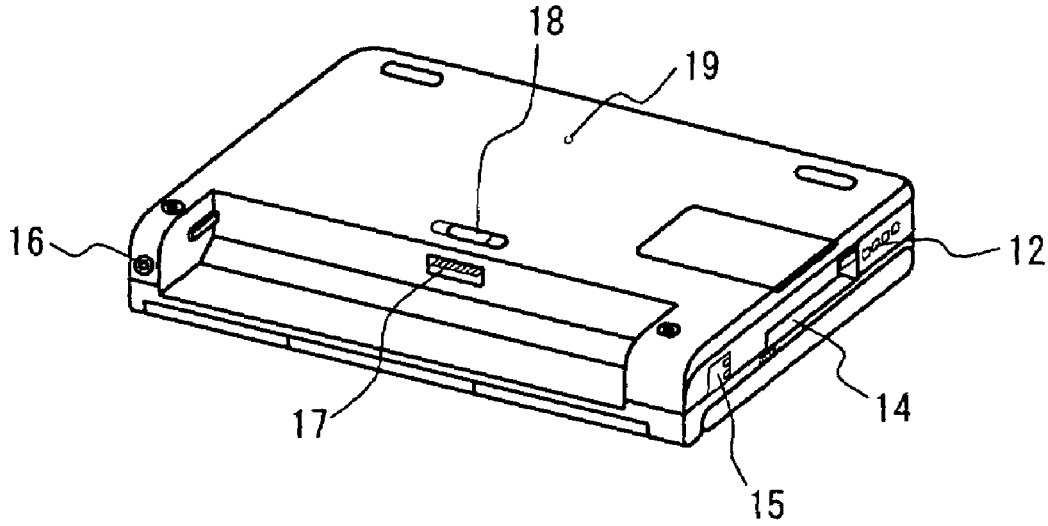
FIG. 3 is an illustration showing the configuration of a rear side and an under surface of the main body.

Furthermore, as shown in FIG. 3, on the rear side of the main body 2, an external power source connector 16 is provided, and at the bottom surface, a slide type removing lever 18 for removing a battery pack (not shown in the figure) and a reset switch 19 for interrupting the operation and reconfiguring the environment at the time of feeding of the power source are provided. Herein, the battery pack is connected to a battery connector 17 in a way in which installation and removal are freely performed.

In addition to such a configuration, to the upper surface (FIG. 1) of the main body 2, in the right end section, between an operating key 4A corresponding to a back space key and an operating key 4B corresponding to an enter key, a jog dial 30 is assembled so that it may have the same height as the above described operating keys 4A, 4B.

Here, the jog dial 30 is a user interface excellent in operability, by which the system setting or various functions in various types of application software can easily be realized by the rotational operation or the pressing operation of the dial.

Figure 4:
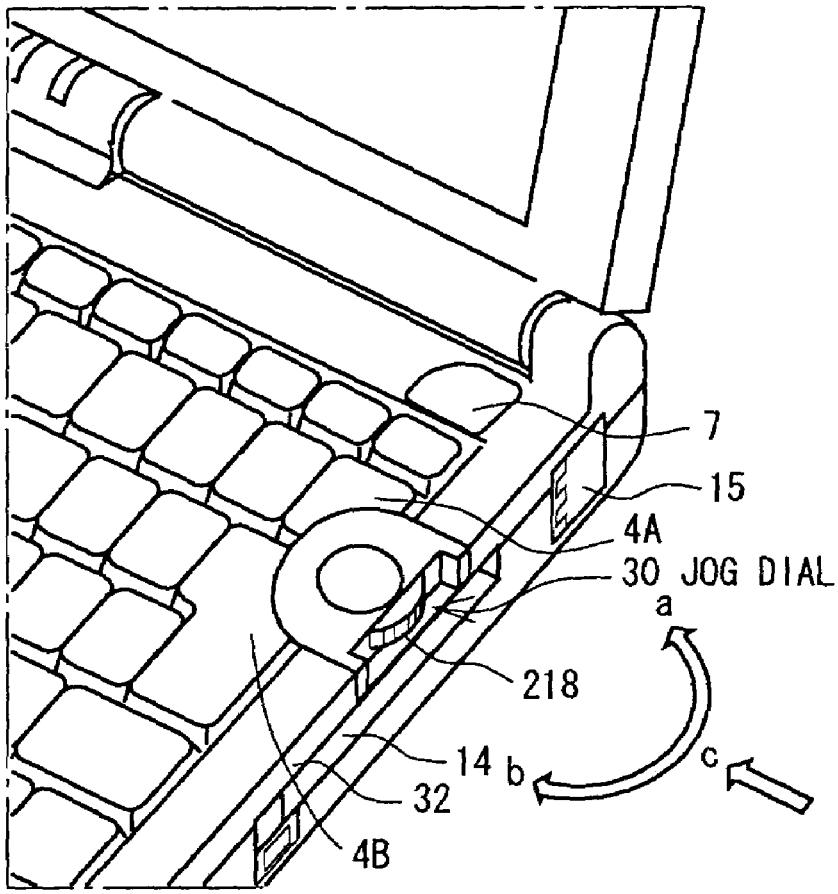
FIG. 4 is an illustration showing the external appearance of a jog dial attached to the main body.

This jog dial 30 is attached, as shown in FIG. 4, in the state where a disc-like operating knob 218 with a parallel pattern is a little projecting from an armoring case 32 of the main body 2, and it is arranged that a specified processing is executed according to a rotational operation in the direction shown by arrow a or the direction shown by arrow b with the disc-like operating knob 218, and that a specified processing is executed according to a pressing operation in the direction shown by arrow c.

At this moment, since the jog dial 30 is mounted so that the disc-like operating knob 218 may be a little projected from the armoring case 32 of the main body 2, a user can easily operate the peripheral side surface 218A of the projecting disc-like operating knob 218 while making a finger creep on the armoring case 32 (FIG. 4). Herein, in the disc-like operating knob 218, the thickness thereof can be decreased as long as the stiffness is insured, and consequently, it is possible to sufficiently comply with thinning of the main body 2.

Figure 5:
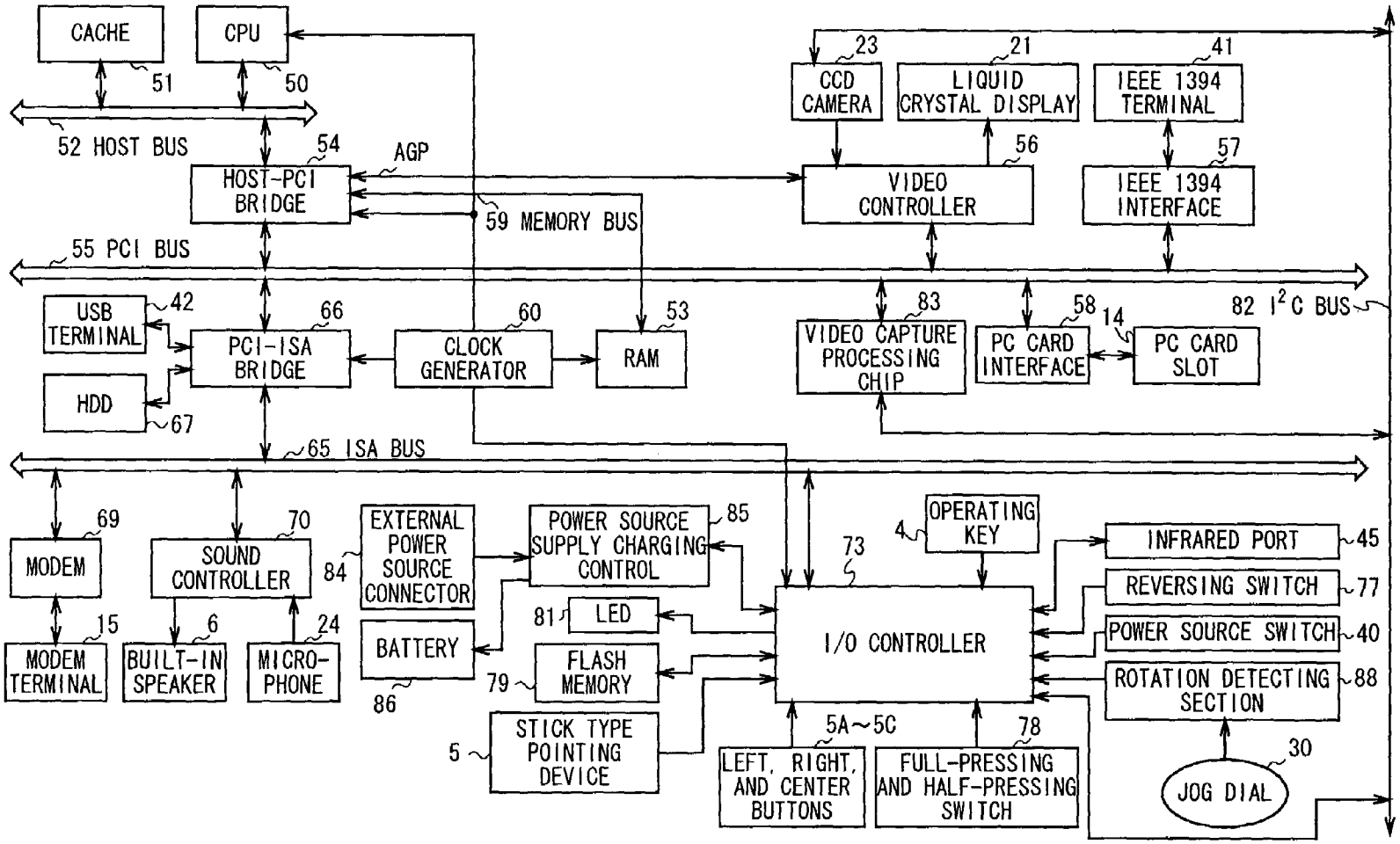
FIG. 5 is a block diagram showing the circuit configuration of the notebook-sized personal computer.

Next, the circuit configuration of the note-PC 1 will be described in detail by using FIG. 5. In the main body 2 of the note-PC 1, a Central Processing Unit (CPU) 50 that generally controls various functions in the above described main body 2 is connected to a host bus 52, and it is arranged that various functions can be realized by executing the processing according to various programs and application software loaded in a Random Access Memory (RAM) 53 by the above described CPU 50 at a specified operating speed on the basis of a system clock given from a clock generator 60.

Furthermore, to the host bus 52, a cache memory 51 is connected, and it is arranged that the data to be used by the CPU 50 is cached and a high speed access can be realized.

This host bus 52 is connected to a Peripheral Component Interconnect (PCI) bus 55 through a host-PCI bridge 54, and to the above described PCI bus 55, a video controller 56, an Institute of Electrical and Electronics Engineers (IEEE) 1394 interface 57, a video capture processing chip 83, and a Personal Computer (PC) card interface 58 are connected.

Here, the host-PCI bridge 54 is arranged so that it may control the giving and receiving of the various data, which are performed between the CPU 50 and the video controller 56, video capture processing chip 83, IEEE 1394 interface 57, and PC card interface 58, and that it may perform the memory control of the RAM 53 connected through a memory bus 59.

Furthermore, the host-PCI bridge 54 is connected to the video controller 56 through a signal wire along an Accelerated Graphics Port (AGP), and consequently, it is arranged that the picture data can be transmitted at a high speed between the host-PCI bridge 54 and the video controller 56.

The video capture processing chip 83 is connected to an $I^2C$ bus 82 (generally, also called a System management (SM) bus) of a serial bus, and it is arranged that when the picture data that is image-picked up by the Charge Coupled Device (CCD) camera 23 is supplied through the above described $I^2C$ bus 82, this is once stored in a built-in frame memory (not shown in the figure), and by performing the picture compression processing according to Joint Photographic Experts Group (JPEG) standard, the JPEG picture data is produced, and after that, the above described JPEG picture data is again stored in a frame memory.

Then, the video capture processing chip 83 directly transmits the JPEG picture data stored in the frame memory to the RAM 53 by using the bus master function according to the request from the CPU 50, and after that, it transmits the data to a hard disc drive (HDD) 67 as the JPEG picture (static picture) data or the Motion JPEG picture (dynamic picture) data.

The video controller 56 is arranged so that it may apply the specified graphics processing to the picture data that is image-picked up by the Charge Coupled Device (CCD) camera 23 or the JPEG picture data of the video capture processing chip 83, and after that, it may store the data in a built-in Video Random Access Memory (VRAM) to read out the data on occasion, and it may output the data to the liquid crystal display 21 to display that.

Furthermore, the video controller 56 is arranged so that a plurality of window screens can be displayed by outputting the picture data based on various kinds of timely supplied application software to the liquid crystal display 21.

The PC card interface 58 is arranged so that it may properly be mounted through a PC card when adding an optional function, and it is arranged so that it can be connected to an external device such as a CD-ROM drive or a DVD drive through a PC card.

The IEEE 1394 interface 57 is directly connected to the IEEE 1394 terminal 41, and it is arranged so that it may be connected to an external device such as another computer device or a digital video camera through the above described IEEE 1394 terminal 41.

The PCI bus 55 is connected to an Industrial Standard Architecture (ISA) bus 65 through a PCI-ISA bridge 66, and to the above described PCI-ISA bridge 66, an HDD 67 and a Universal Serial Bus (USB) terminal 42 are connected.

Here, the PCI-ISA bridge 66 is configured by an Integrated Drive Electronics (IDE) interface, a configuration register, a Real-Time Clock (RTC) circuit, and a USB interface or the like, and it performs the control of the HDD 67 through the IDE interface on the basis of the system clock given from the clock generator 60.

In a hard disc of the HDD 67, an Operating System (OS) such as Windows 98 (trademark), an electronic mail program, an auto-pilot program, a jog dial utility program, a jog dial driver, capture software, and digital map software, and further, various kinds of application software other than these are stored, and they are transmitted to the RAM 53 on occasion in the process of the starting processing.

Furthermore, the PCI-ISA bridge 66 controls external devices such as a floppy disc drive, a printer, and a USB mouse that are connected through a USB terminal 42 and are not shown in the figure, through the USB interface, and in the meantime, it controls a modem 69 and a sound controller 70 that are connected to an ISA bus 65.

The modem 69 is connected to an internet service provider (hereafter, this is called a provider) through a public telephone line and an internet that are not shown in the figure from a modem terminal 15, so that it may access the above described provider.

The sound controller 70 converts a sound signal taken in from the microphone 24 into digital to produce the sound data, and it outputs this to the CPU 50 and in the meantime, it converts the sound data supplied from the CPU 50 into analog to produce the sound signal, and it outputs this to the outside through the built-in speaker 6.

Furthermore, to the ISA bus 65, an In/Out (I/O) controller 73 is connected, and it receives the supply of the power from an external power source connector 84 through a power source supply charging control circuit 85, and it performs the supply of the power to each circuit when the power source switch 40 is turned on. Furthermore, here, the I/O controller 73 also operates on the basis of the system clock supplied from the clock generator 60.

Furthermore, the power source supply charging control circuit 85 is controlled by the I/O controller 73, and it controls the charging of the battery pack 86 connected to the battery connector 17 (FIG. 3).

This I/O controller 73 is configured by a micro controller, an I/O interface, a CPU, a ROM, and a RAM or the like, and it controls the input and output of the data between the OS or application software and the various peripheral apparatus such as the liquid crystal display 21 or HDD 67 on the basis of Basic Input/Output System (BIOS) stored in a flash memory 79.

Furthermore, the I/O controller 73 is connected to the infrared port 45, and it is arranged so that the infrared communication may be performed, for example, with another computer device. Moreover, the I/O controller 73 is connected to a reversing switch 77, and when the image-pickup section 22 of the CCD camera 23 is rotated by 180 degrees in the direction of the rear side of the liquid crystal display 21, the reversing switch 77 is turned on, and the CPU 50 is notified of that effect through the PCI-ISA bridge 66 and the host-PCI bridge 54.

Moreover, the I/O controller 73 is connected to a full-pressing and half-pressing switch 78, and when the shutter button 7 provided on the upper surface of the main body 2 is made in the half-pressed state, the full-pressing and half-pressing switch 78 is turned on, and the CPU 50 is notified of that effect, and in the meantime, when the shutter button 7 is made in the fully-pressed state, the full-pressing and half-pressing switch 78 is turned on, and the CPU 50 is notified of that effect.

That is, in the state where the capture software is raised on the RAM 53 from the hard disc of the HDD 67, when the shutter button 7 is made in the half-pressed state by the user, the CPU 50 enters the static picture mode, and it controls the CCD camera 23 to execute the freeze of the static picture, and when the shutter button 7 is made in the fully-pressed state, it takes in the frozen static picture data and sends out the data to the video controller 56.

On the contrary, the CPU 50 is arranged so that it may enter the dynamic picture mode to take in the dynamic picture up to a maximum of about 60 seconds and that it may send out that to the video controller 56 when the shutter button 7 is made in the fully-pressed state by the user in the state where the capture software is not raised.

Herein, in the ROM of the I/O controller 73, a wake-up program, a key input monitoring program, an LED control program, and a jog dial state monitoring program, and other various control programs are stored.

Here, the jog dial state monitoring program is a program related to the jog dial utility program stored in the hard disc of the HDD 67, and it is a program for monitoring whether the jog dial 30 is operated by the rotational operation or pressing operation or not.

The wake-up program is a program that is controlled by the CPU 50 so that it may execute a specified processing when the present time supplied from the RTC circuit in the PCI-ISA bridge 66 becomes the previously set starting time, and the key input monitoring program is a program for monitoring the input from the operating key 4 and other key switches.

The LED control program is a program for controlling the lighting of various lamps made of the light Emitting Diode (LED) such as a power source lamp PL, a battery lamp BL, or a message lamp ML.

Furthermore, in the RAM of the I/O controller 73, a set time register for the wake-up program, a key input monitoring register for the key input monitoring program, an LED control register for the LED control program, and an I/O register for the jog dial state monitoring program, and registers for other various programs are provided.

The set time register is arranged so that it may store the time information of the starting time that is previously and arbitrarily set by the user for being used in the wake-up program. Accordingly, the I/O controller 73 judges whether the present time supplied from the RTC circuit has become the arbitrarily set starting time or not on the basis of the wake-up program, and when the time has become the starting time, it notifies the CPU 50 of that effect. Consequently, the CPU 50 raises a previously set specified application software when the time has become the starting time, and executes a specified processing according to the above described application software.

The key input monitoring register is arranged so that it may store an operating key flag on the basis of the input of the operating key 4, stick 5, left click button 5A, right click button 5B, and center button 5C.

Accordingly, based on the key input monitoring program, the I/O controller 73 judges, for example, whether the pointing operation by the stick 5 or the clicking operation of the left click button 5A, right click button 5B, and center button 5C is performed or not on the basis of the state of the operating key flag, and when the pointing operation or clicking operation is performed, it notifies the CPU 50 of that effect.

Here, the pointing operation means an operation of moving the mouse cursor to a desired position by pressing and operating the stick 5 upward or downward and leftward or rightward by a finger, and the clicking operation means an operation of quickly pressing and releasing the left click button 5A or right click button 5B by a finger.

Consequently, the CPU 50 executes a specified processing according to the movement of the mouse cursor by the pointing operation or the clicking operation.

The LED control register is arranged so that it may store the lighting flag indicating the lighting state of various lamps made of the LED such as the power source lamp PL, battery lamp BL, or message lamp ML.

Accordingly, the I/O controller 73 stores the lighting flag, when the CPU 50 reads an electronic mail program out of the hard disc of the HDD 67 and raises that on the RAM 53 and receives an electronic mail according to the above described electronic mail program, for example, by the pressing operation of the jog dial 30, and in the meantime, it lights the message lamp ML by controlling the LED 81 on the basis of the above described lighting flag.

The I/O register for the jog dial state monitoring program is arranged so that it may store a rotational operation flag and a pressing operation flag according to the rotational operation and pressing operation performed to the jog dial 30, respectively.

Accordingly, the I/O controller 73 stores the rotational operation flag and pressing operation flag in the I/O register when a menu item desired by the user is selected from among a plurality of menu items by the rotational operation and pressing operation of the jog dial 30 connected through a rotation detecting section 88, and in the meantime, it notifies the CPU 50 of that effect.

Consequently, according to the jog dial utility program that has been read out of the HDD 67 and started on the RAM 53, the CPU 50 raises the application software corresponding to the menu item determined by the rotational operation and pressing operation of the jog dial 30, and it executes a specified processing.

Here, the I/O controller 73 is operating at all times on the basis of the jog dial state monitoring program by the control of the power source supply charging control circuit 85, even in the state where the power source switch 40 is turned off and the OS is not started, and it is arranged so that it may start the application software or script file desired by the user, by the pressing operation of the jog dial 30 even in the state of power-saving or even when the power source is turned off, without providing a special key.

Herein, the I/O controller 73 is connected to an $I^2C$ bus 82, and it is arranged so that it may control the on/off of the camera power source in the CCD camera 23 or that it may adjust the degree of brightness or contrast in the CCD camera 23, by supplying various set parameters to the CCD camera 23 set by the operating key 4 or jog dial 30, through the $I^2C$ bus 82.

(2) Spectrum Analyzer Program

Furthermore, in the note-PC 1, the CPU 50 reads the previously registered music data out of the HDD 67 and reproduces that from the speaker 24, on the basis of the spectrum analyzer program (hereafter, this is called the SPE-ANA program) stored in the HDD 67, and in the meantime, it frequency-analyzes the sound of the above described music data for each specified band, and on the basis of the result of the above described analysis, it produces a spectrum analyzer picture (hereafter, this is called a SPE-ANA picture) Pspc indicating the signal level for each band.

Then, the CPU 50 reads a plurality of previously registered static picture data (hereafter, this is called a registered picture Preg) out of the HDD 67, and selects one among the above described plurality of read-out registered pictures Preg as the selected picture Psel, and further, it composes the above described selected picture Psel and SPE-ANA picture Pspc to produce a composed picture Pcomp, and it displays the picture on the liquid crystal display 21. At this moment, the CPU 50 changes the selected picture Psel on the basis of the result of the analysis of the music data, and in the meantime, it changes the composing method of the selected picture Psel and SPE-ANA picture Pspc.

Figure 6:
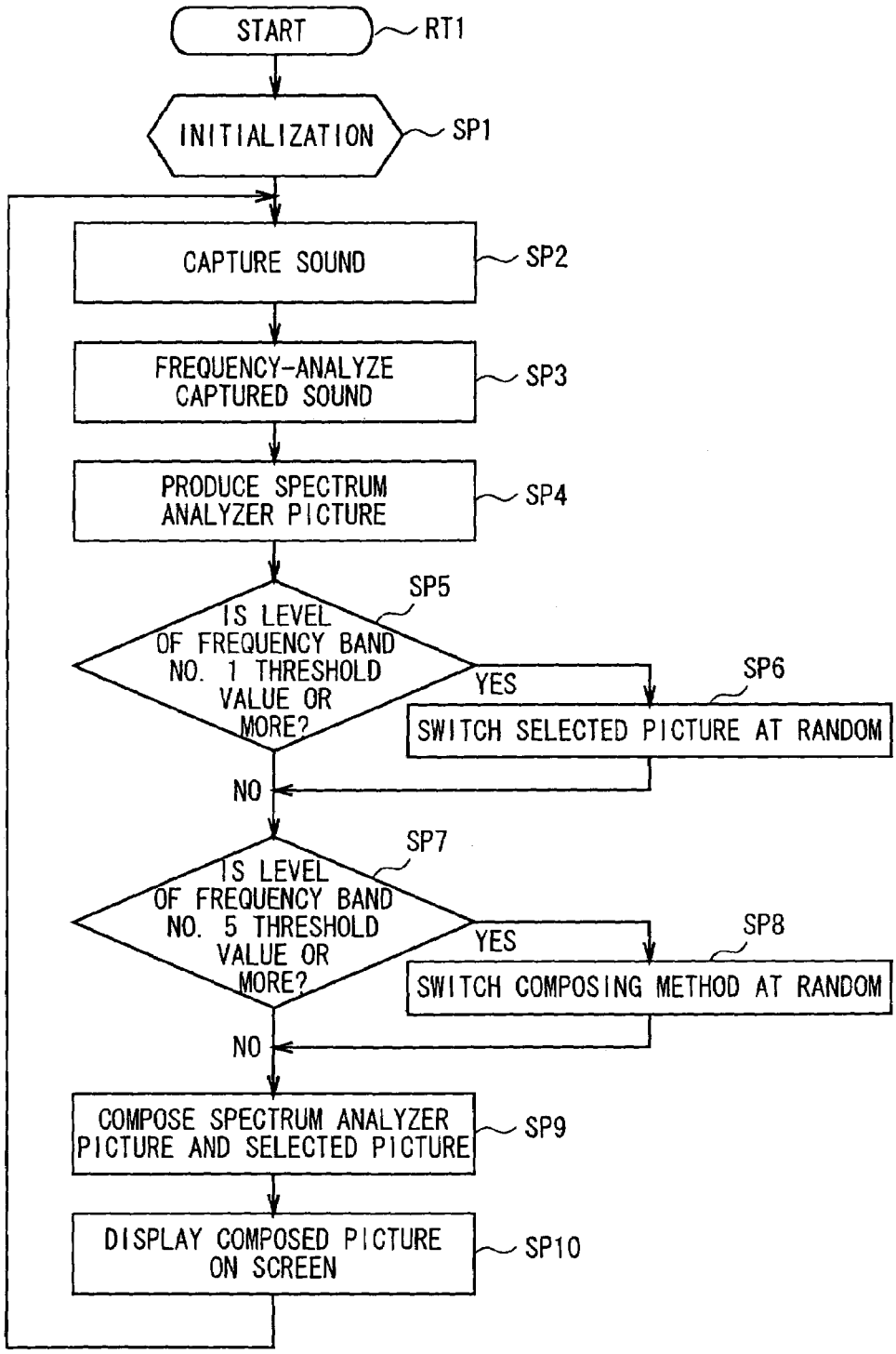
FIG. 6 is a flow chart showing a processing procedure of a spectrum analyzer program.

That is, the CPU 50 starts the spectrum analyzer processing procedure shown in FIG. 6 according to the starting operation of the SPE-ANA program by the user.

The CPU 50 starts the processing at RT1, and at STEP SP1, the CPU 50 performs the initialization processing, and reads out a plurality of registered pictures Preg stored in the HDD 67 to the RAM 53, and it selects one among the above described plurality of read-out registered pictures Preg, and in the meantime, it selects one among four types of picture composing methods to be described later. Then, the CPU 50 reads the music data out of the HDD 67, and starts the reproduction.

At step SP2, the CPU 50 as the sound signal obtaining means takes in the sound of the music data during the reproduction (hereafter, this is called capture), and it moves to the next step SP3.

At step SP3, the CPU 50 as the sound signal analyzing means frequency-analyzes the captured sound by using Fast Fourier Transform (FFT), and it moves to the next step SP4.

Figure 7:
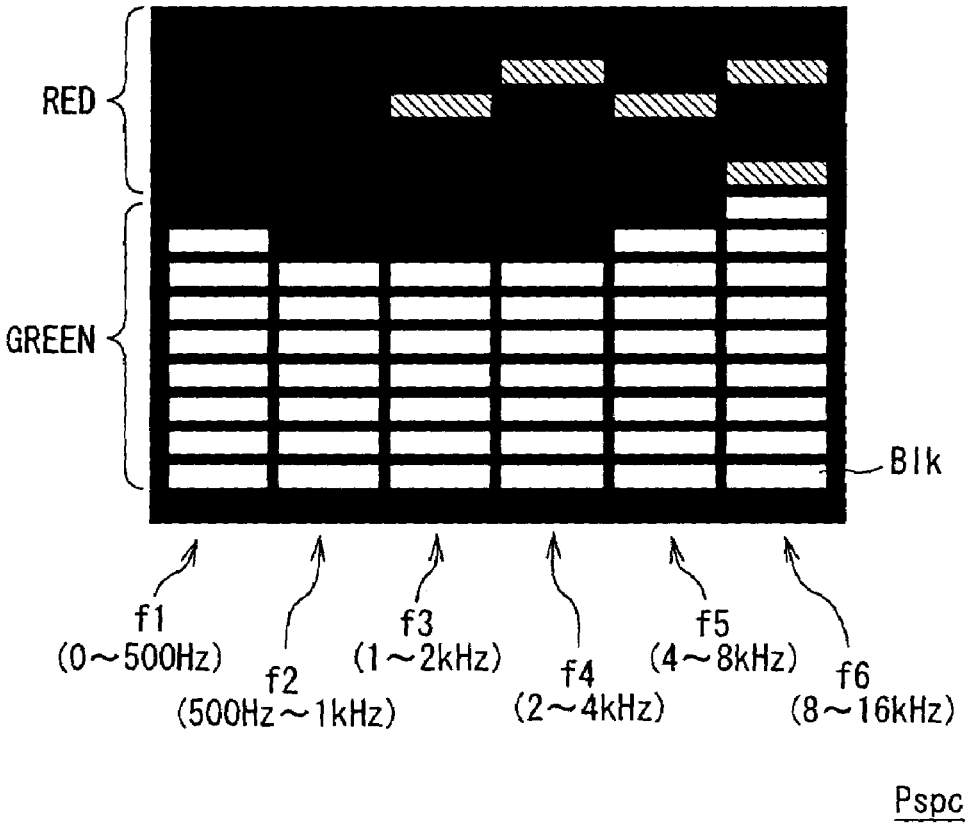
FIG. 7 is an illustration showing a spectrum analyzer picture.

At step SP4, the CPU 50 as the frequency-analyzed picture producing means produces a SPE-ANA picture on the basis of the result of the frequency analysis. That is, FIG. 7 shows a SPE-ANA picture Pspc, and six indicators f1 to f6 are displayed.

Each of the indicators f1 to f6 is configured by fourteen display blocks B1*k*, and nine display blocks B1*k* from the bottom are displayed in green, and in the meantime, five display blocks B1*k* from the top are displayed in red. Furthermore, the background of the indicators f1 to f6 is displayed in black.

Each of the indicators f1 to f6 indicates a signal level of the corresponding frequency band, and the height of each indicator fluctuates according to the sound during the reproduction. That is, the indicator f1 indicates the signal intensity of a band (frequency band No. 1) of 0 to 500 Hz, and the indicator f2 indicates the signal intensity of a band (frequency band No. 2) of 500 Hz to 1kHz, and the indicator f3 indicates the signal intensity of a band (frequency band No. 3) of 1 to 2 kHz. Furthermore, the indicator f4 indicates the signal intensity of a band (frequency band No. 4) of 2 to 4 kHz, and the indicator f5 indicates the signal intensity of a band (frequency band No. 5) of 4 to 8 kHz, and the indicator f6 indicates the signal intensity of a band (frequency band No. 6) of 8 to 16 kHz.

At step SP5, the CPU 50 as the selected picture switching means judges whether the signal level of the frequency band No. 1 is a specified threshold value or more or not. In the case where a negative result is obtained at step SP5, this expresses that the signal level of the frequency band No. 1 is less than the specified threshold value, and the CPU 50 moves to step SP 7.

On the contrary, in the case where an affirmative result is obtained at step SP5, this expresses that the signal level of the frequency band No. 1 is the specified threshold value or more, and the CPU 50 advances to step SP6. At step SP6, the CPU 50 selects one among a plurality of registered pictures Preg at random to let this be the selected picture Psel, and it moves to step SP7.

Here, the frequency band No. 1 corresponds to the area of the low-pitched sound of a dram, a bass or the like in the music. Therefore, the CPU 50 switches the selected picture Psel by using the low-pitched sound of a drum, a bass or the like in the music data during the reproduction, as a trigger.

At step SP7, the CPU 50 judges whether the signal level of the frequency band No. 5 is a specified threshold value or more or not. In the case where a negative result is obtained at step SP7, this expresses that the signal level of the frequency band No. 5 is less than the specified threshold value, and the CPU 50 moves to step SP9.

On the contrary, in the case where an affirmative result is obtained at step SP7, this expresses that the signal level of the frequency band No. 5 is the specified threshold value or more, and the CPU 50 advances to step SP8. At step SP8, the CPU 50 selects one among four types of picture composing methods at random.

Here, the frequency band No. 5 corresponds to the area of the medium-and-high-pitched sound of the vocal or the like in the music. Therefore, the CPU 50 switches the picture composing method by using the vocal or the like in the music data during the reproduction as a trigger.

Figure 9:
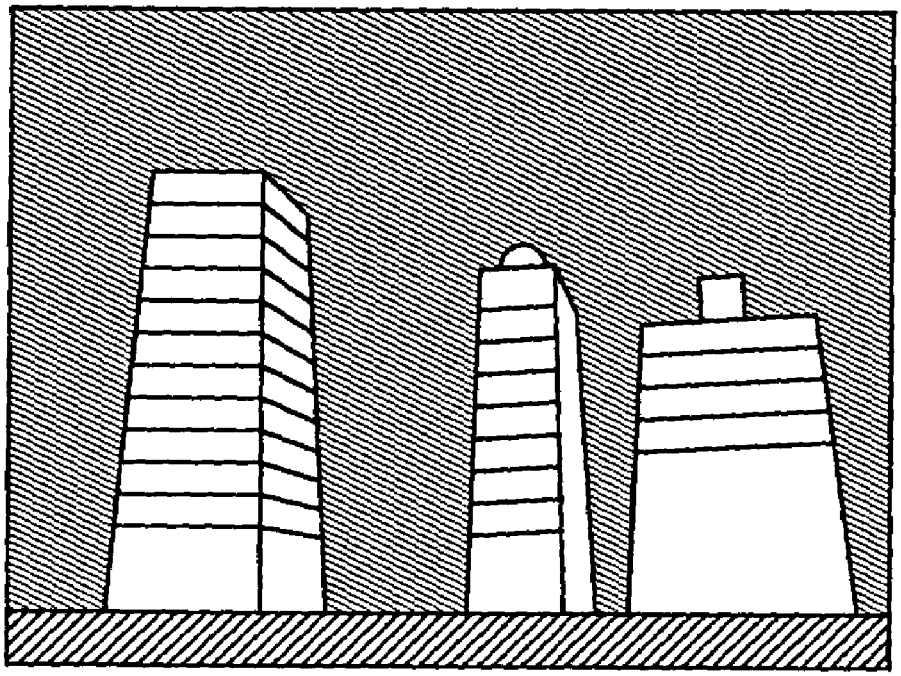
FIG. 9 is an illustration showing a selected picture.

That is, FIG. 8A shows the composition of pictures using OR (logical sum), and a composed picture Pcomp is produced by performing the logical sum for each corresponding bit, in each corresponding picture element of the selected picture Psel and SPE-ANA picture Pspc that are each expressed in color of 24 bits (eight bits for each of R, G, B). For example, in the case where the selected picture Pse shown in FIG. 9 and the SPE-ANA picture Pspc (FIG. 7) are composed by using the logical sum, a composed picture Pcomp shown in FIG. 10 A is produced. In the case of this composed picture Pcomp, in the part corresponding to the background section of the SPE-ANA picture Pspc, the pattern of the selected picture Psel is displayed as it is, and in the part corresponding to the green indicator of the SPE-ANA picture Pspc, the green component of the selected picture Psel is emphasized, and in the part corresponding to the red indicator of the SPE-ANA picture Pspc, a pattern in which the red component of the selected picture Psel is emphasized is made.

Figure 10A:
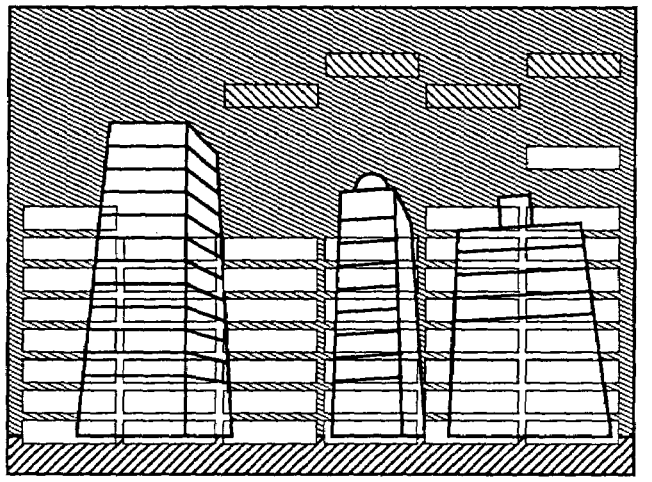
FIG. 10 is an illustration showing a composed picture.
Figure 10B:
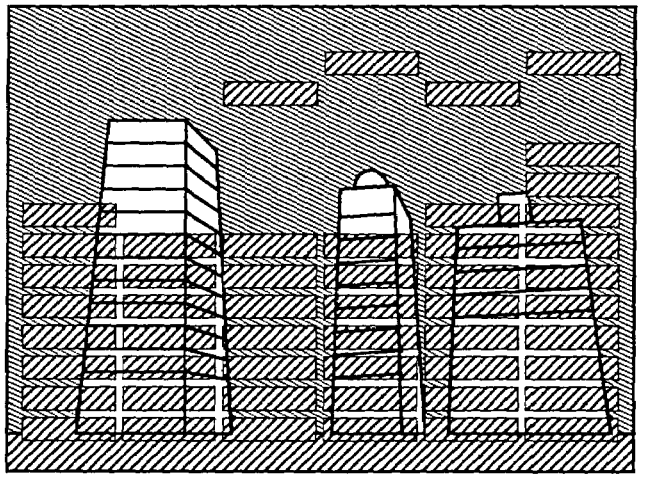
Figure 11:
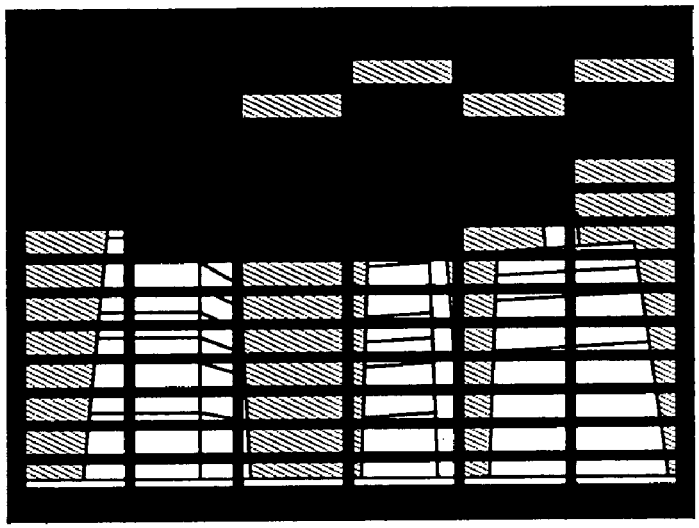
FIG. 11 is an illustration showing a composed picture.
Figure 11:
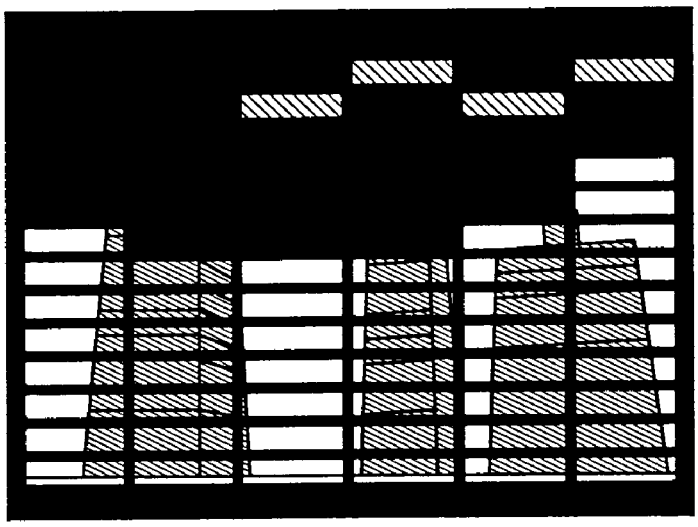

FIG. 8B shows the composition of pictures using XOR (exclusive-OR), and a composed picture Pcomp is produced by performing the exclusive-OR for each corresponding bit, in each corresponding picture element of the selected picture Psel and the SPE-ANA picture Pspc. That is, FIG. 10B shows a composed picture Pcomp by XOR, and in the part corresponding to the background section of the SPE-ANA picture Pspc, the pattern of the selected picture Psel is displayed as it is, and in the part corresponding to the green indicator of the SPE-ANA picture Pspc, the green component of the selected picture Psel is bit-inverted, and in the part corresponding to the red indicator of the SPE-ANA picture Pspc, the red component of the selected picture Psel is bit-inverted.

FIG. 8C shows the composition of pictures using logical multiplication (AND), and a composed picture Pcomp is produced by performing the logical multiplication for each corresponding bit, in each corresponding picture element of the selected picture Psel and the SPE-ANA picture Pspc. That is, FIG. 10C shows a composed picture Pcomp by AND, and the part corresponding to the background section of the SPE^ANA picture Pspc is displayed in black, and in the part corresponding to the green indicator of the SPE-ANA picture Pspc, only the green component of the selected picture Psel is displayed, and in the part corresponding to the red indicator of the SPE-ANA picture Pspc, only the red component of the selected picture Psel is displayed.

FIG. 8D shows the composition of pictures using inverted AND, and a composed picture Pcomp is produced by performing the logical multiplication for each corresponding bit, in each corresponding picture element of the inverted selected picture Psel and the SPE-ANA picture Pspc. That is, FIG. 10D shows a composed picture Pcomp by inverted AND, and the part corresponding to the background section of the SPE-ANA picture Pspc is displayed in black, and in the part corresponding to the green indicator of the SPE-ANA picture Pspc, only the green component of the inverted selected picture Psel is displayed, and in the part corresponding to the red indicator of the SPE-ANA picture Pspc, only the red component of the inverted selected picture Psel is displayed.

In such a composition of pictures by logical operations, the amount of calculations is less than that of the alpha-blending or the like that is generally used as a picture composing method, and the picture composition can be processed at a high speed. Therefore, even in the case where the music rhythm is fast and the selected picture Psel or the composing method is switched at a high speed, it is possible to produce a selected picture Psel following the change in rhythm.

At step SP9, the CPU 50 as the composed picture display means composes the selected picture Psel and the SPE-ANA picture Pspc to produce a composed picture Pcomp, and it moves to the next step SP10.

At step SP10, the CPU 50 as the composed picture display means displays the produced composed picture Pcomp on the liquid crystal display 21 for a specified time, and after that, it returns to step SP2.

Thus, the CPU 50 switches the selected picture Psel by using the low-pitched sound of a drum, a bass or the like in the music data during the reproduction as a trigger, and in the meantime, it switches the picture composing method by using the vocal or the like as a trigger, and it displays the composed picture Pcomp.

(3) Operation and Effect in Embodiments

In the above described configuration, the CPU 50 of the note-PC 1 executes a spectrum analyzer program, and it frequency-analyzes the music data during the reproduction for each specified band and produces a SPE-ANA picture Pspc.

Then, the CPU 50 selects one among a plurality of registered pictures Preg as a selected picture Psel, and composes the above described selected picture Psel and SPE-ANA picture Pspc by using the logical operation, and it displays that on the liquid crystal display 21 as a composed picture Pcomp.

At this moment, the CPU 50 switches the selected picture Psel on the basis of the change of the area of the low-pitched sound in the music data, and in the meantime, it switches the picture composing method on the basis of the change of the area of the medium-and-high-pitched sound in the music data.

According to the above described configuration, by switching the selected picture Psel and the picture composing method on the basis of the change of the music data, it is possible to display a composed picture Pcomp that changes irregularly according to the change of the music data, and in the meantime, by composing the selected picture Psel and the SPE-ANA picture Pspc by using the logical operation whose composition processing time is short, it is possible to change the selected picture Psel without being late for the change of the music data.

(4) Other Embodiments

Herein, in the above described embodiment, the selected picture Psel and the picture composing method have been switched on the basis of the music data stored in the HDD 67, but the present invention is not limited to this, and it is also possible to switch the selected picture Psel and the picture composing method on the basis of the music by various sound sources such as the music inputted from the microphone 24 or the music of a music CD reproduced by the CD-ROM drive connected to the note-PC 1.

Furthermore, in the above described embodiment, the selected picture Psel and the picture composing method have been switched on the basis of the music data, but the present invention is not limited to this, and it is also possible to switch the selected picture Psel and the picture composing method on the basis of various sounds, for example, a natural sound such as the sound of the wave or a human voice.

Furthermore, in the above described embodiment, the composed picture Pcomp has been produced by composing the registered picture Preg that is a static picture and the SPE-ANA picture Pspc, but the present invention is not limited to this, and it is also possible to produce the composed picture Pcomp by composing, for example, a dynamic picture and the SPE-ANA picture Pspc.

Furthermore, in the above described embodiment, the selected picture Psel has been switched by using the low-pitched sound in the music data during the reproduction as a trigger, but the present invention is not limited to this, and it is also possible to switch the selected picture Psel by using various changes of the music data as a triger, for example, by using the medium-pitched sound as a trigger. Furthermore, it is also possible to give a visual special effect such as wiping or defusing when switching the selected picture Psel.

Furthermore, in the above described embodiment, a case has been described, where the CPU 50 produces and displays the composed picture Pcomp on the basis of the spectrum analyzer program previously stored in the hard disc of the HDD 67, but the present invention is not limited to this, and it is also possible to perform the display of the above described composed picture Pcomp by installing a program storing medium in which a spectrum analyzer program is recorded.

Thus, as a program storing medium that is used for making a state where a spectrum analyzer program for executing the above described series of processing is installed in a note-PC 1 and is capable of being executed by the above described note-PC 1, the program storing medium can be realized not only by a package media such as a floppy disc, a Compact Disc Read-Only Memory (CD-ROM), or a Digital Versatile Disc (DVD) but also by a semiconductor memory, a magnetic disk or the like in which a program is temporarily or permanently stored. Furthermore, as means for storing a program in these program storing media, it is also possible to utilize the cable and wireless communication media such as the local area network and internet, or the digital satellite broadcasting, and it is also possible to store the program in the state where various communication interfaces such as a router or a modem is intervening.

Furthermore, in the above described embodiment, a case has been described, where the information processing device of the present invention is applied to a notebook-sized personal computer 1, but the present invention is not limited to this, and it is also possible to apply the device to a desktop type personal computer.

As mentioned above, according to the present invention, a composed picture that changes with the change of the sound can be produced and displayed by switching the selected picture on the basis of the change of the sound, and by simultaneously changing the composing method of the frequency-analyzed picture and the selected picture on the basis of the change of the sound.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. An information processing device comprising:

sound signal obtaining means for obtaining a sound signal;

sound signal analyzing means for frequency-analyzing said obtained sound signal;

frequency-analyzed picture producing means for producing a specified frequency-analyzed picture on the basis of a result of said frequency-analysis;

first judging means for judging whether or not a level of a first frequency band is above a first predetermined threshold value;

selected picture switching means that switches and selects one among a plurality of registered pictures as a selected picture on the basis of said level of said first frequency band of the analyzed sound signal from said sound signal analyzing means, when said first judging means judges that said level of said first frequency band is above said first predetermined threshold value;

second judging means for judging whether or not a level of a second frequency band is below a second predetermined threshold value;

composed picture display means that displays a composed picture produced by composing said frequency-analyzed picture and said selected picture, when said second judging means judges that said level of said second frequency band is below said second predetermined threshold value; and for changing means for changing a composing process of said frequency analyzed picture and said selected picture on the basis of said level of said second frequency band of the analyzed sound signal from said sound signal analyzing means, when said second Judging means judges that said level of said second frequency band is above said second predetermined threshold value.

2. The information processing device according to claim 1, wherein said composed picture display means produces said composed picture by logically operating a picture element of said frequency-analyzed picture and a corresponding picture element of said selected picture.

3. An information processing device comprising:

sound signal obtaining means for obtaining a sound signal taken in from a microphone;

sound signal analyzing means for frequency-analyzing said obtained sound signal;

frequency-analyzed picture producing means for producing a specified frequency-analyzed picture on the basis of a result of said frequency-analysis;

storing means for storing a plurality of pictures;

first judging means for judging whether or not a level of a first frequency band is above a first predetermined threshold value;

selected picture switching means that switches and selects one among a plurality of said registered pictures as a selected picture on the basis of said level of said first frequency band of the analyzed sound signal from said sound signal analyzing means, when said first judging means judges that said level of said first frequency band is above said first predetermined threshold value;

second judging means for judging whether or not a level of a second frequency band is below a second predetermined threshold value;

composed picture display means that displays a composed picture produced by composing said frequency-analyzed picture and said selected picture, when said second judging means judges that said level of said second frequency band is below said second predetermined threshold value; and composing method changing means that changes a composing method of said frequency analyzed picture and said selected picture on the basis of said level of said second frequency band of the analyzed sound signal from said sound signal analyzing means, when said second judging means judges that said level of said second frequency band is above said second predetermined threshold value.

4. The information processing device according to claim 3, wherein said composed picture display means produces said composed picture by logically operating a picture element of said frequency-analyzed picture and a corresponding picture element of said selected picture.

5. A picture producing method comprising the steps of:

obtaining a sound signal;

frequency-analyzing said obtained sound signal;

producing a specified frequency-analyzed picture on the basis of a result of said frequency-analysis;

judging whether or not a level of a first frequency band is above a first predetermined threshold value via a first judging means;

switching and selecting one among a plurality of registered pictures as a selected picture on the basis of said level of said first frequency band of the analyzed sound signal, when said first judging means judges that said level of said first frequency band is above said first predetermined threshold value;

judging whether or not a level of a second frequency band is below a second predetermined threshold value via a second judging means;

displaying a composed picture produced by composing said frequency-analyzed picture and said selected picture, when said second judging means judges that said level of said second frequency band is below said second predetermined threshold value; and changing a composing method of said frequency analyzed picture and said selected picture on the basis of said level of said second frequency band of the analyzed sound signal, when said second judging means judges that said level of said second frequency band is above said second predetermined threshold value.

6. The picture producing method according to claim 5, wherein said step of displaying a composed picture produces said composed picture by logically operating a picture element of said frequency-analyzed picture and a corresponding picture element of said selected picture.

7. A program storing medium that makes an information processing device execute a program, said medium comprising the steps of:

obtaining a sound signal;

frequency-analyzing said obtained sound signal;

producing a specified frequency-analyzed picture on the basis of a result of said frequency-analysis;

judging whether or not a level of a first frequency band is above a first predetermined threshold value via a first judging means;

switching and selecting one among a plurality of registered pictures as a selected picture on the basis of said level of said first frequency band of the analyzed sound signal, when said first judging means judges that said level of said first frequency band is above said first predetermined threshold value;

judging whether or not a level of a second frequency band is below a second predetermined threshold value via a second judging means;

displaying a composed picture produced by composing said frequency-analyzed picture and said selected picture, when said second judging means judges that said level of said second frequency band is below said second predetermined threshold value; and changing a composing method of said frequency analyzed picture and said selected picture on the basis of said level of said second frequency band of the analyzed sound signal, when said second judging means judges that said level of said second frequency band is above said second predetermined threshold value.

8. The program storing medium according to claim 7, wherein said step of displaying a composed picture produces said composed picture by logically operating a picture element of said frequency-analyzed picture and a corresponding picture element of said selected picture.

* * * * *